US006450114B1

(12) United States Patent
Conroy

(10) Patent No.: US 6,450,114 B1
(45) Date of Patent: Sep. 17, 2002

(54) WATER CRAFT

(76) Inventor: Dianne Conroy, 480 Pukehina Parade, RD9, Pukehina, Te Puke (NZ)

( * ) Notice: Subject to any disclaimer, the term of this patent is extended or adjusted under 35 U.S.C. 154(b) by 0 days.

(21) Appl. No.: 09/614,330

(22) Filed: Jul. 12, 2000

(30) Foreign Application Priority Data

Jul. 12, 1999 (NZ) ..... 336760

(51) Int. Cl.[7] ..... B63B 35/14

(52) U.S. Cl. ..... 114/255; 114/39.23; 43/4; 446/160

(58) Field of Search ..... 446/153, 154, 446/160, 163; 43/4, 26.1; 114/39.21, 39.23, 104, 255

(56) References Cited

U.S. PATENT DOCUMENTS 3,585,952 A * 6/1971 Head ..... 114/122
3,765,362 A * 10/1973 Gitchel ..... 114/144 A
4,651,666 A * 3/1987 Lake ..... 114/39.23
4,951,589 A * 8/1990 Pfeffer ..... 114/104
5,069,648 A * 12/1991 Ozeki ..... 114/140
5,154,016 A * 10/1992 Fedora et al. ..... 43/26.1
5,529,007 A * 6/1996 Fitzpatrick ..... 114/124
5,581,932 A * 12/1996 Bell ..... 43/26.1

* cited by examiner

*Primary Examiner*—Stephen Avila
(74) *Attorney, Agent, or Firm*—Klauber & Jackson

(57) ABSTRACT

With reference to FIG. 1, the invention is a water craft. The water craft has a hull 1 and a sail arrangement, and carries a fishing line and baited hook. The water craft can sail across a body of water unmanned to a desired location for fishing. The water craft has control means which enables a fisherman on-shore to cause the water craft's sail to drop, thus minimizing further movement of the water craft. The water craft has self righting means 23 which causes it to revert back to a normal in-use orientation if it is overturned while on the body of water. More particularly, the self righting means incorporates a weight which is acted on by gravity to pull the water craft into the normal in use orientation.

10 Claims, 6 Drawing Sheets

WATER CRAFT

FIELD OF THE INVENTION

This invention relates to water craft. In particular, a preferred form of the invention relates to an unmanned water craft for use in fishing.

In the context of on-shore fishing it is desirable for a fisherman to be able to drop a baited hook held by a line some distance from the shore. To achieve this it is known to use a small unmanned water craft to carry a baited hook and line to a desired water position some way from the shore. Such craft are normally attached to a safety line which is held by the fisherman on shore. However, a problem with this mode of fishing is that it is difficult to control the distance traveled by the craft out across the water. A further problem is that in the event of a wave overturning the craft it must be dragged back to shore, still overturned, by way of the attached safety line. It is accordingly an object of at least one form of the invention to go at least some way towards addressing at least one of the above problems.

In interpreting this specification, including the associated claims, the term "comprising" or "comprises" or "comprise" should be taken to be non-exclusive—ie should be taken to mean "consisting of or including".

SUMMARY OF THE INVENTION

According to one aspect of the invention there is provided a small unmanned water craft for carrying a fishing line to which a fishing hook is attached across a body of water, the water craft comprising a sail arrangement and control means, the sail arrangement comprising a sail which can be in a hoisted position and can subsequently assume a non-hoisted position, the control means being such that when the water craft is in use sailing across the body of water the control means can be activated from a shore position remote from the water craft to cause the sail to assume the non-hoisted position.

Preferably the control means comprises a control line which can extend from the water craft to the shore position, and wherein a suitable pulling force on the control line activates the control means to release the sail to move to the non-hoisted position. Alternatively, the control means can be activated from the shore position by way of an electronic remote control to cause the sail to move to the non-hoisted position.

Preferably the control means comprises a shaft and a release arm, the control means being such that the shaft can contact the release arm to prevent the sail from moving to the non-hoisted position, and the shaft can then be moved away from contact with the release arm to enable the sail to move under gravity to assume the non-hoisted position.

Preferably the control means comprises a rotatable axis, the release arm extending from the axis, the arrangement being such that suitable rotation of the axis causes the sail to move under gravity to assume the non-hoisted position.

Preferably the control means comprises a release catch, the release catch extending from the axis, the sail arrangement comprising a thread or threads extending from the sail and being held by the release catch, the control means being such that rotation of the axis causes the release catch to release the thread or threads, the release of the thread or threads causing the sail to move under gravity to assume the non-hoisted position.

Preferably the control means comprises a housing and a spring, the shaft being held at least partially within the housing and being biased towards the sail arrangement by way of the spring, the control means being such that the shaft can contact the release arm under pressure from the spring to prevent the sail from moving to the non-hoisted position, and the shaft can then be moved away from contact with the release arm by overcoming the pressure from the spring to enable the axis to rotate.

According to another aspect of the invention there is provided a water craft suitable for controlled unmanned use in carrying a fishing line to which a fishing hook is attached across a body of water, the water craft comprising self righting means, the self righting means comprising a weight arranged to be acted on by gravity to pull the water craft to a normal sailing orientation if the water craft is overturned while in use on the body of water.

Preferably the self righting means comprises a tubular member housing the weight, the weight being moveable under gravity within the tubular member.

Preferably the self righting means comprises a first tubular member housing the weight, and a second tubular member, the first and second tubular members being in a substantially "V" shaped configuration and each being at an acute angle with respect to horizontal when the water craft is in a normal in-use orientation.

Some preferred forms of the invention will now be described by way of example and with reference to the accompanying drawings, of which:

DETAILED DESCRIPTION

Figure 1:
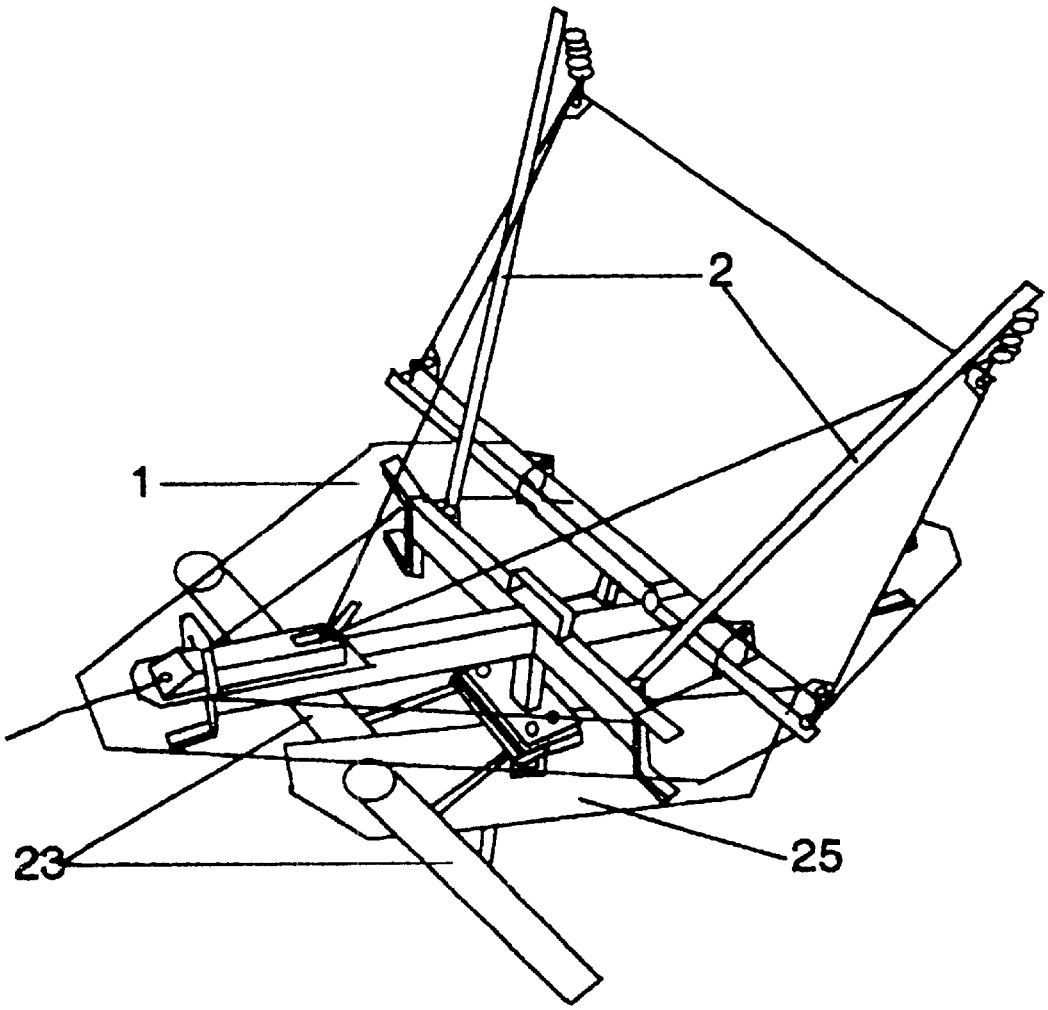
FIG. 1 is a perspective view of a water craft suitable for use in fishing.
Figure 2:
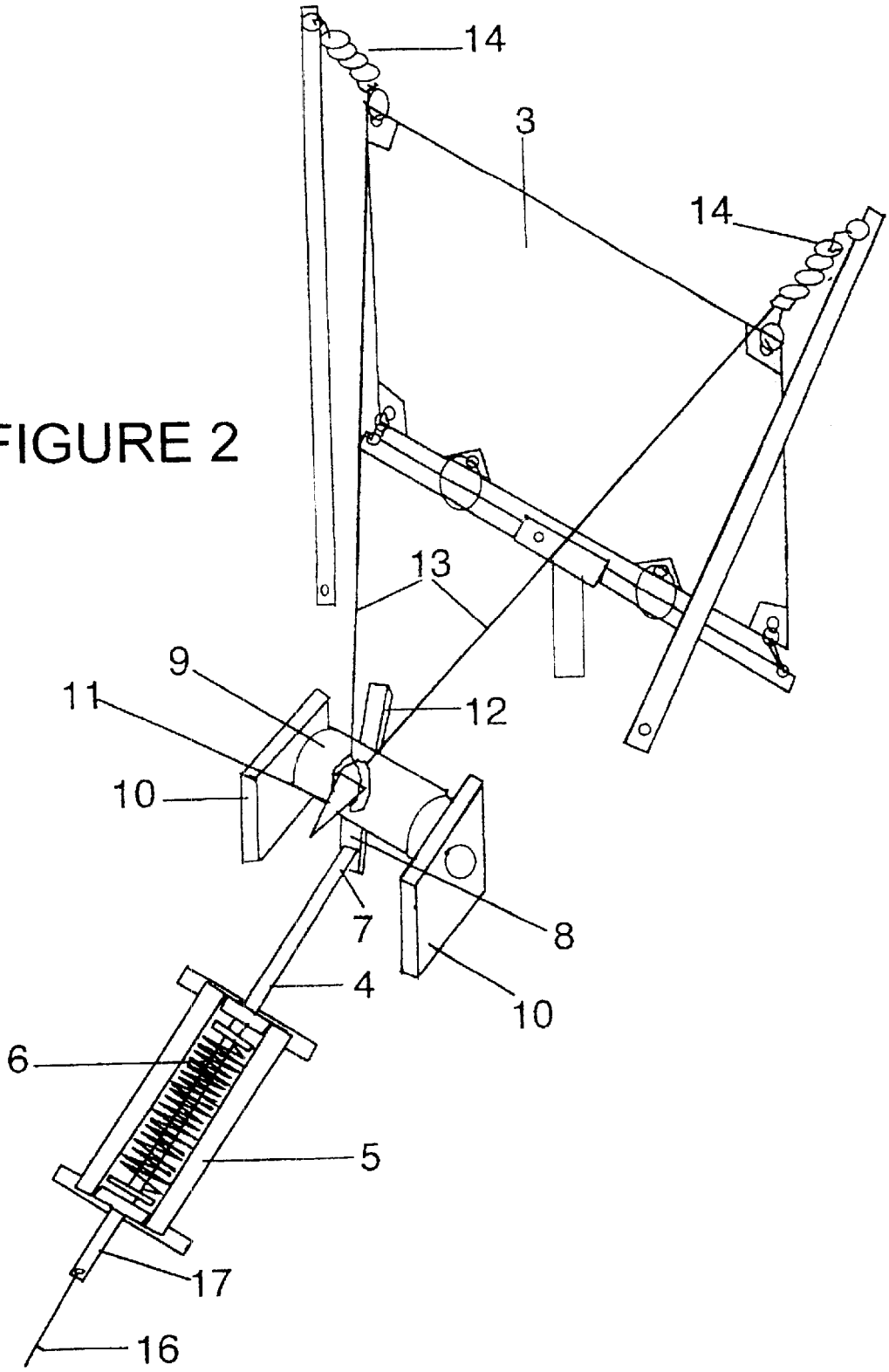
FIGS. 2 and 3 show detail of a control means and sail arrangement forming part of the water craft.
Figure 3:
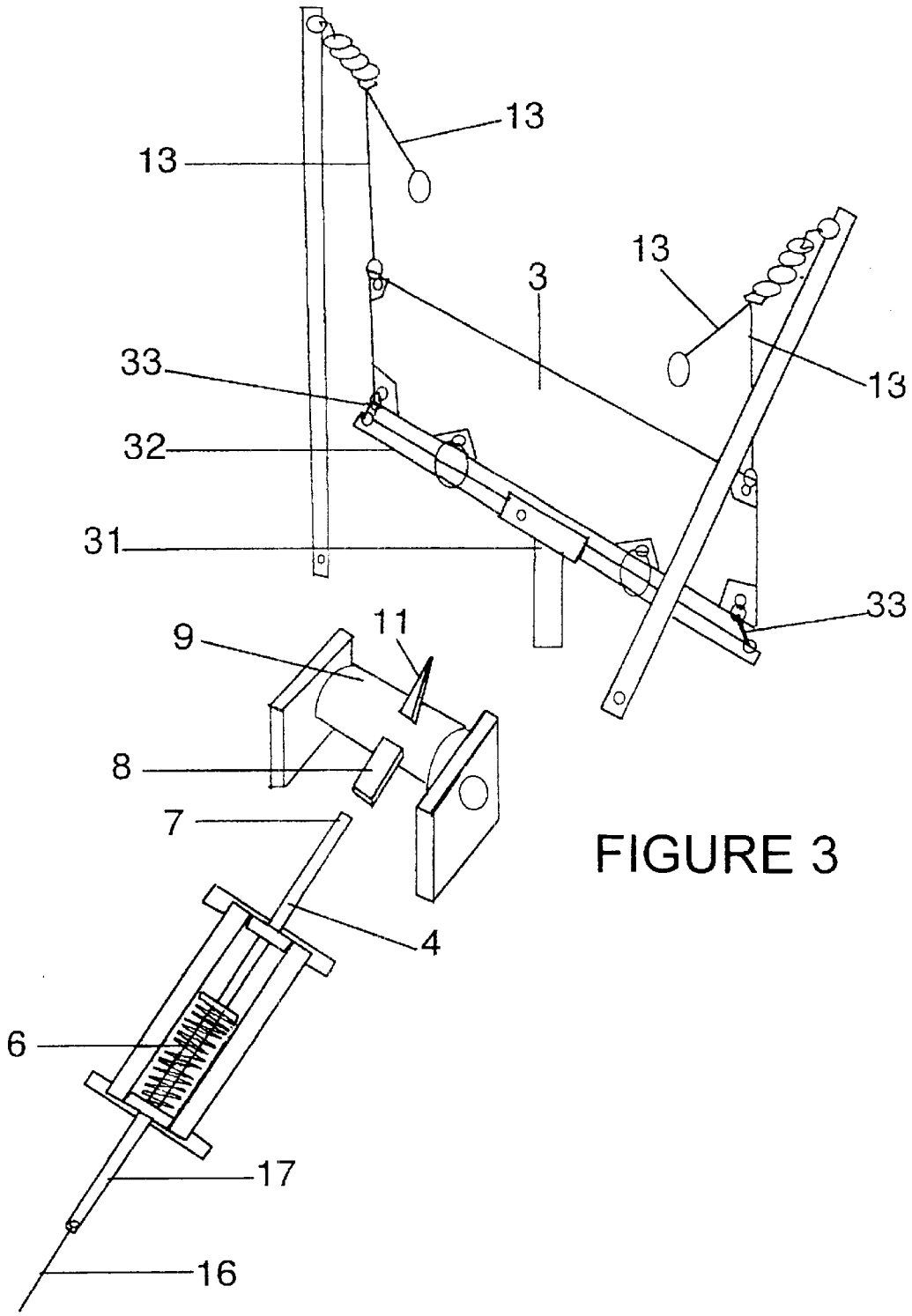

With reference to FIGS. 1, 2 and 3, the water craft is of a small size and is used for carrying a baited hook held by a hook line (not shown) across a body of water to a desired position for fishing. The craft is unmanned and, when in use, is set out sailing across the water while a fisherman on shore holds a control line 16 attached to the craft. The craft has a hull 1, and a sail arrangement which includes twin masts 2 and a sail 3. With particular reference to FIG. 3, the sail arrangement includes a sail cross rod 32 at the base of the sail 3. The sail 3 is secured to the cross rod 32 by way of sail clips or rings 33. As shown, the cross rod 32 is supported in a substantially horizontal orientation by way of a sleeve-like cross rod holder 31. The sail arrangement enables the craft to be driven by the wind to the desired position for fishing.

When the desired position is reached it is preferable to drop the sail 3 to prevent significant further travel of the craft. To achieve this there is provided a "control means". More particularly, the control means comprises a shaft 4 extending through a housing 5. A spring 6 is arranged within the housing 5 to bias the shaft 4 towards the sail arrangement. With particular reference to FIGS. 2 and 3, when the sail 3 is in a hoisted position a forward end 7 of the shaft 4 contacts and prevents movement of a sail release arm 8. The sail release arm 8 extends outwards from an axis 9 which is at least partially rotatable on mounting brackets 10. A release catch 11 and a reset handle 12 also extend outwards from the axis 9.

With further reference to FIGS. 2 and 3, the sail 3 is held in a hoisted position by threads 13 extending from the sail 3 and looped onto the release catch 11. More particularly, the threads 13 extend from the release catch 11, pass through ring-like spring arrangements 14, and are secured to upper outer parts of the sail 3. The ring-like spring arrangements 14 facilitate tension in the threads 13 when the sail 3 is hoisted.

To drop the sail 3 a fisherman on shore pulls sharply on the control line 16 attached to an end 17 of the shaft 4 which is opposite the shaft's forward end 7. Pulling on the control line 16 serves to counter the spring 6 to move the forward end 7 of the shaft 4 away from the release arm 8. As shown at FIG. 3, moving the forward end 7 away from the release arm 8 causes the axis 9 to partially rotate, thus moving the release catch 11 upwards and towards the sail 3. As the release catch 11 moves in this way the threads 13, which are under tension, pull free from the release catch 11 thus enabling the sail 3 to drop under gravity. To return the craft to shore at the conclusion of fishing one need only pull on a line attached to the craft, which may or may not be the same as the control line 16.

The control means described above comprises the shaft 4, the housing 5, the spring 6, the release arm 8, the axis 9, the mounting brackets 10, the release catch 11, and the reset handle 12. However, it should be appreciated that other embodiments of the invention may utilize an alternative control means.

Figure 4:
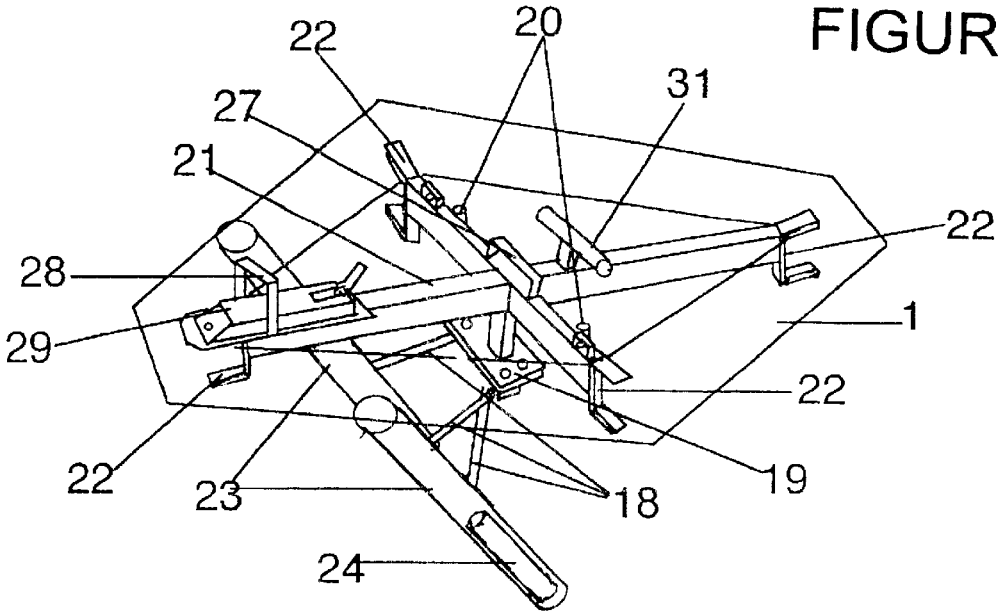
FIGS. 4–8 show detail of various parts of the water craft.
Figure 5:
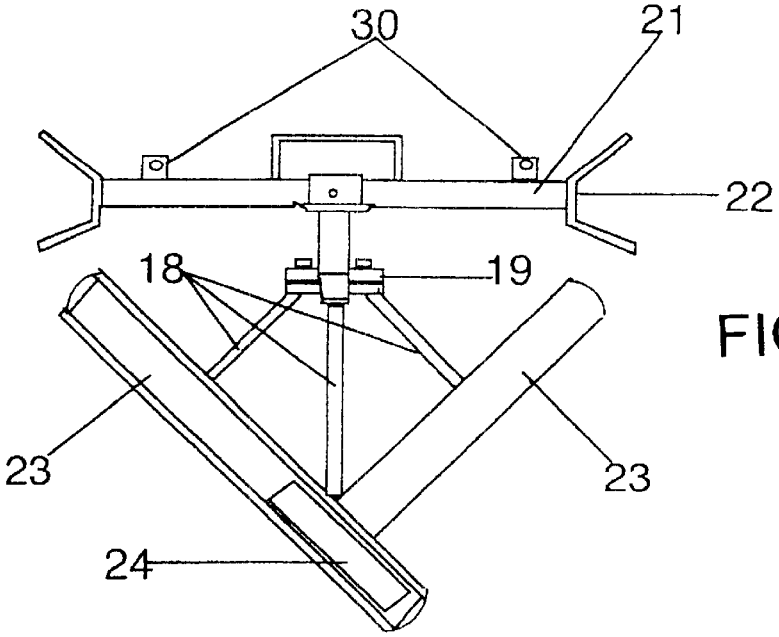

With reference to FIGS. 4 and 5, the craft has self righting means 23. The self righting means 23 comprises two tubes combined to give a sealed substantially "V" shaped configuration. As can be seen, the two tubes are at a downwards acute angle with respect to the hull 1 rather than being at right angles with respect to the hull. The self righting means 23 also comprises a weight 24 slideable under gravity within one of the two tubes. In a normal in-use position the weight 24 is below water level beneath the hull 1. With reference to FIG. 5, the self righting means 23 incorporates three bars 18 which serve to hold the self righting means 23 in position with respect to the rest of the water craft.

Figure 8:
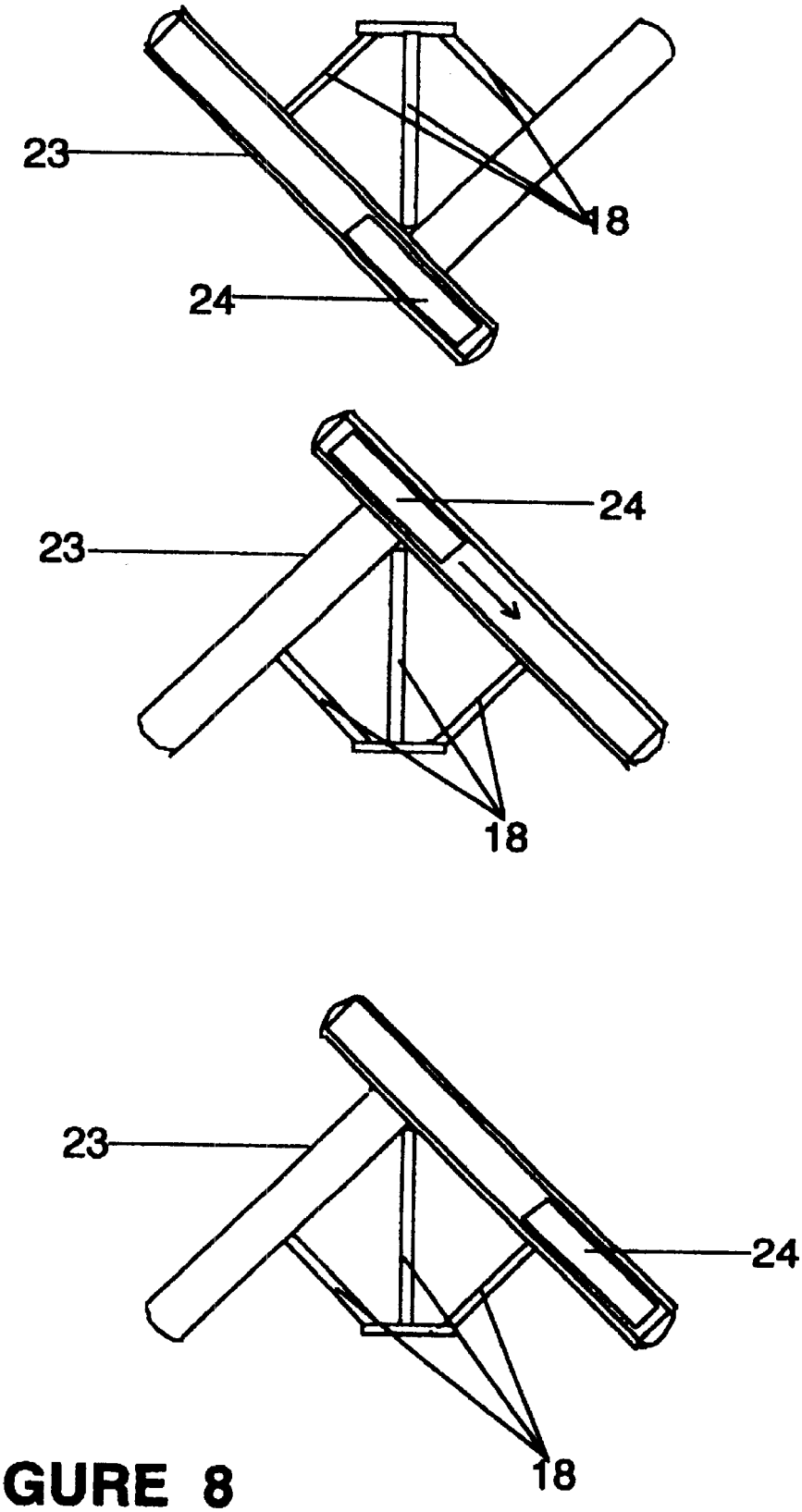

If the water craft is overturned by a wave while in use it is able to right itself without the need for the fisherman to drag it back to shore while overturned. This is possible due to the self righting means 23. More particularly, and with reference to FIG. 8, if the water craft is overturned by a wave, etc, the weight 24 moves under gravity to pull the water craft into a correct upright sailing orientation.

Referring to FIGS. 4 and 5, the bars 18 are attached to a mounting plate 19. The mounting plate 19 is attached to a substantially "T" shaped frame 21, the "T" shaped frame 21 having two mast holders 20. As demonstrated in FIGS. 4 and 5, there are base brackets 22 extending from the end of each arm of the "T" shaped frame 21 to assist in securing the hull 1 in place. Optionally the water craft has sail connection mounts 30.

As shown in FIG. 4, the water craft has handles 27 and 28 to enable the water craft to be readily carried by a fisherman when it is not in use. FIG. 4 also shows a cover 29 for the shaft 4, the housing 5, and the spring 6.

Figure 6:
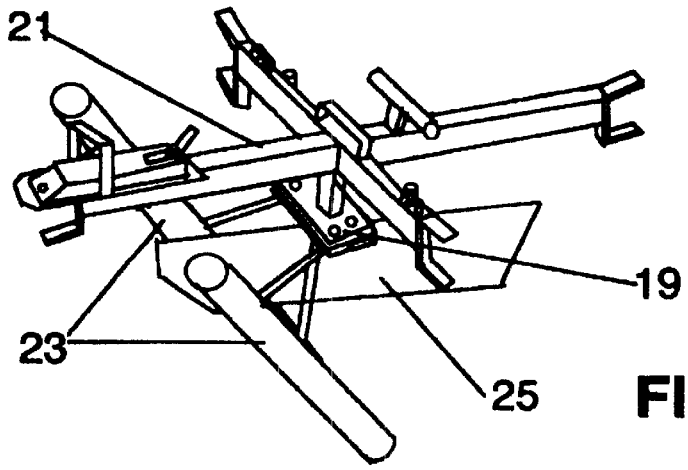
Figure 7:
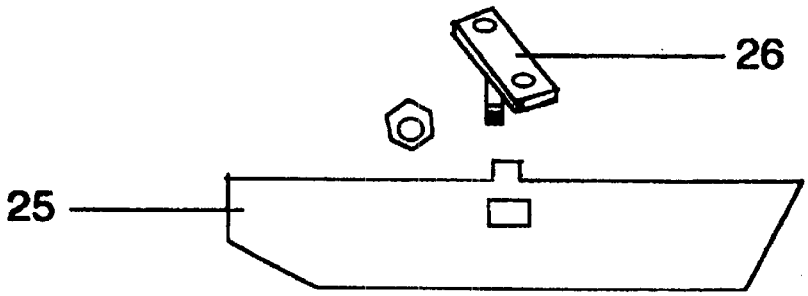

With reference to FIGS. 6 and 7, the water craft includes a keel 25 which can be set at a desired angle to control the sailing direction of the water craft. The keel 25 is attached to the base plate 19 by way of a connector 26. The connector may or may not form part of the base plate 19.

In alternative embodiments of the invention the water craft may be formed with only one mast. Also, the self righting means may comprise a keel held out to one side of the rest of the water craft below the water line, rather than the self righting means being in the form of two tubes in a "V" shaped configuration as described above. In this embodiment the keel 25 described above may be dispensed with. When the self righting means is in the form of a keel held to one side of the water craft it is that keel which also defines a weight for causing the water craft to revert to a normal orientation if over-turned.

In further embodiments of the invention the control line 16 may be dispensed with in favor of a an electronic remote control for triggering dropping of the sail 3. Moreover, some forms of the invention may include a facility to enable a fisherman to hoist the sail after it has been dropped even while the water craft is still waterborne at a location remote from the fisherman. The sail may be so hoisted by way of remote electronic control, or by mechanical means—eg a suitable water-to-shore line.

While some preferred forms of the invention have been described by way of example, it should be appreciated that improvements and modifications can occur without departing from the scope of the appended claims.

I claim:

1. A water craft for carrying a fishing line to which a fishing hook is attached across a body of water, the water craft comprising a sail arrangement and control means, the sail arrangement comprising a sail which can be in a hoisted position and can subsequently assume a non-hoisted positions, the control means being such that when the water craft is in use sailing across the body of water the control means can be activated from a share position remote from the water craft to cause the sail to assume the non-hoisted position to prevent significant further movement of the water craft across the body of water, the control means comprising a shaft and a release art, the control means being such that the shaft can contact the release arm to prevent the sail from moving to the non-hoisted position, and the shaft can then be moved away from contact with the release arm to enable the sail to move under gravity to assume the non-hoisted position.

2. A water craft according to claim 1, wherein the control means includes a rotatable axis, the release arm extending from the axis, the control means being such that the shaft can contact the release arm to prevent the sail from moving to the non-hoisted position, and the shaft can then be moved away from contact with the release arm to enable the axis to rotate to cause the sail to move under gravity to assume the non-hoisted position.

3. A water craft according to claim 1, wherein the control means includes a rotatable axis and a release catch, the release arm and the release catch extending from the axis, the sail arrangement comprising a thread or threads extending from the sail and being held by the release catch, the control means being such that the shaft can contact the release arm to prevent the sail from moving to the non-hoisted position, and the shaft can then be moved away from contact with the release arm to enable the axis to rotate thereby causing the release catch to release the thread or threads, the release of the thread or threads causing the sail to move under gravity to assume the non-hoisted position.

4. A water craft according to claim 1, wherein the control means includes a housing, a spring, a rotatable axis, and a release catch, the shaft being held at least partially within the housing and being biased towards the sail arrangement by way of the spring, the release arm and the release catch extending from the axis, the sail arrangement comprising a thread or threads extending from the sail and being held by the release catch, the control means being such that the shaft can contact the release arm under pressure from the spring to prevent the sail from moving to the non-hoisted position, and the shaft can then be moved away from contact with the release arm by overcoming the pressure from the spring to enable the axis to rotate, the rotation of the axis causing the release catch to release the thread or threads to enable the sail to move under gravity and assume the non-hoisted position.

5. A water craft according to claim 1, comprising self righting means, the self righting means comprising a weight arranged to be acted on by gravity to pull the water craft to a normal sailing orientation if the water craft is overturned while in use on the body of water.

6. A water craft according to claim 1, comprising self righting means, the self righting means comprising a tube member housing a weight, the weight being moveable within the tube member, the self righting means being formed such that if the water craft is overturned while in use on the water the weight is acted on by gravity to move and pull the water craft to a normal sailing orientation.

7. A water craft according to claim 1, comprising self righting means, the self righting means comprising a first tube member housing a weight, the self righting means also comprising a second tube member, the first and second tube members being in a substantially "V" shaped configuration, the weight being moveable within the first tube member, the self righting means being formed such that if the water craft is overturned while in use on the water the weight is acted on by gravity to move and pull the water craft to a normal sailing orientation.

8. A water craft according to claim 1, comprising self righting means, the self righting means comprising a first tube member housing a weight, the self righting means also comprising a second tube member, the first and second tube members being in a substantially "V" shaped configuration at an acute angle to horizontal when the water craft is in a normal in-use orientation, the weight being moveable within the first tube member, the self righting means being formed such that if the water craft is overturned while in use on the water the weight is acted on by gravity to move and pull the water craft to a normal sailing orientation.

9. A water craft, comprising self righting means, the self righting means comprising a weight arranged to be acted on by gravity, without assistance from or manipulation by a human, to pull the water craft to a normal sailing orientation if the water craft is overturned while in use on a body of water, the weight being housed in a tubular member such that the weight is moveable under gravity within the tubular member.

10. A water craft according to claim 9, wherein the self righting means comprises a further tubular member, the two tubular members being in a substantially "V" shaped configuration and wherein the two tubular members are each at an acute angle with respect to horizontal when the water craft is in a normal in-use orientation.

* * * * *